US010751865B2

(12) United States Patent
Pedicini et al.

(10) Patent No.: US 10,751,865 B2
(45) **Date of Patent: *Aug. 25, 2020**

(54) IMPACTING APPARATUS

(71) Applicant: Tricord Solutions, Inc., Franklin, TN (US)

(72) Inventors: Christopher Pedicini, Franklin, TN (US); John Witzigreuter, Canton, GA (US)

(73) Assignee: Tricord Solutions, Inc., Franklin, TN (US)

( * ) Notice: Subject to any disclaimer, the term of this patent is extended or adjusted under 35 U.S.C. 154(b) by 482 days.

This patent is subject to a terminal disclaimer.

(21) Appl. No.: 15/402,198

(22) Filed: Jan. 9, 2017

(65) Prior Publication Data

US 2018/0001461 A1 Jan. 4, 2018

Related U.S. Application Data

(63) Continuation-in-part of application No. 15/012,498, filed on Feb. 1, 2016, now Pat. No. 9,539,714.

(60) Provisional application No. 62/276,439, filed on Jan. 8, 2016.

(51) Int. Cl.

| | |
|---|---|
| ***B25C 1/04*** | (2006.01) |
| ***B25D 11/10*** | (2006.01) |
| ***B25D 11/00*** | (2006.01) |
| ***B25C 1/06*** | (2006.01) |
| *E04H 17/26* | (2006.01) |
| *B21J 15/26* | (2006.01) |

(52) U.S. Cl.

CPC ..... *B25D 11/10* (2013.01); *B25C 1/047* (2013.01); *B25C 1/06* (2013.01); *B25D 11/005* (2013.01); *B21J 15/26* (2013.01); *B25D 2211/062* (2013.01); *B25D 2222/72* (2013.01); *B25D 2250/375* (2013.01); *E04H 17/263* (2013.01)

(58) Field of Classification Search

CPC .. B25C 1/06; B25C 1/04; B25C 1/047; B25C 1/041; B25C 5/13

See application file for complete search history.

(56) References Cited

U.S. PATENT DOCUMENTS 2,887,686 A * 5/1959 Wandel ..... B25C 1/04 227/130
3,589,588 A * 6/1971 Vasku ..... B25C 1/005 227/132
4,215,808 A * 8/1980 Sollberger ..... B25C 1/041 173/204

(Continued)

*Primary Examiner* — Andrew M Tecco

(74) *Attorney, Agent, or Firm* — Jay Schloff; Aldenbaum Schloff and Bloom PLLC

(57) ABSTRACT

An impacting apparatus includes a spring anvil assembly and a drive mechanism that alternatively engages a the spring anvil assembly to actuate the spring anvil assembly to store potential energy in the spring anvil assembly, and which drive mechanism alternatively disengages the spring anvil assembly to allow the spring anvil assembly to launch and accelerate toward an impact target to deliver impact energy from the spring anvil assembly to the impact target. In an embodiment, the spring anvil assembly is biased to a start position by one of the impact target and the weight of the apparatus. The spring anvil assembly may comprise a gas spring or a spring, for example. The apparatus is capable of delivering multiple impacts to an impact target.

20 Claims, 7 Drawing Sheets

(56) References Cited

U.S. PATENT DOCUMENTS

| | | | | |
|---|---|---|---|---|
| 5,503,319 | A * | 4/1996 | Lai | B25C 5/15 173/203 |
| 5,720,423 | A * | 2/1998 | Kondo | B25C 1/04 227/130 |
| 8,011,441 | B2 * | 9/2011 | Leimbach | B25C 1/047 173/1 |
| 8,763,874 | B2 * | 7/2014 | McCardle | B25C 1/047 227/129 |
| 9,539,714 | B1 * | 1/2017 | Pedicini | B25C 1/06 |
| 10,065,300 | B2 * | 9/2018 | Pedicini | B25C 1/06 |
| 2007/0045377 | A1 * | 3/2007 | Towfighi | B25C 1/04 227/130 |
| 2014/0054350 | A1 * | 2/2014 | Pedicini | B25C 5/15 227/8 |
| 2016/0096259 | A1 * | 4/2016 | Pedicini | B25C 1/047 227/146 |

* cited by examiner

IMPACTING APPARATUS

CROSS-REFERENCE TO RELATED APPLICATIONS

The present disclosure claims priority under 35 U.S.C. § 120 on and is a continuation-in-part of pending U.S. patent application Ser. No. 15/012,498, filed on Feb. 1, 2016, this disclosure of which is incorporated by reference. The present disclosure also claim priority under 35 U.S.C. §119 on pending U.S. Provisional Application Ser. No. 62/276,439, filed on Jan. 8, 2016, the disclosure of which is incorporated by reference.

FIELD OF THE DISCLOSURE

The present disclosure relates to impacting apparatuses, and, more particularly, to such impacting apparatus for driving fence posts, breaking concrete, setting rivets, driving nails and otherwise performing multiple continuous impacts.

BACKGROUND

Impacting apparatuses (also referred to herein as a "driver," "gun" or "device") known in the art often may be configured for an entirely portable operation. Contractors commonly use power-assisted devices for impacting a surface and/or driving an object into a substrate. These power-assisted apparatuses can be portable (i.e., not connected or tethered to an air compressor or wall outlet) or non-portable.

A common impacting apparatus uses a source of compressed air to actuate a guide assembly to push an object into a substrate. For applications in which portability is not required, this is a very functional system and allows rapid delivery of fasteners for quick assembly. A disadvantage is that it does however require that the user purchase an air compressor and associated air-lines in order to use this system. A further disadvantage is the inconvenience of the device being tethered (through an air hose) to an air compressor.

To solve this problem, several types of portable impacting devices operate off of fuel cells. Typically, these guns have a guide assembly in which a fuel is introduced along with oxygen from the air. The subsequent mixture is ignited with the resulting expansion of gases pushing the guide assembly and thus driving an object into a substrate. This design is complicated and expensive. Both electricity and fuel are required as the spark source derives its energy typically from batteries. The chambering of an explosive mixture of fuel, the use of consumable fuel cartridges, the loud report and the release of combustion products are all disadvantages of this solution.

A final commercially available solution is to use a flywheel mechanism and clutch the flywheel to an anvil that impacts a substrate. This tool is capable of impacting very quickly. The primary drawback to such a tool is the large weight and size as compared to pneumatic counterparts. Additionally, the drive mechanism is very complicated, which gives a high retail cost.

Clearly, and based on the above efforts, a need exists to provide portable solution for impacting that is unencumbered by fuel cells or air hoses. Additionally, the solution ought to provide a low reactionary feel, and be simple, cost effective and robust in operation.

The prior art teaches several additional ways of impacting. The first technique is based on a multiple impact design. In this design, a motor or other power source is connected to an impact anvil through either a lost motion coupling or other device. This allows the power source to make multiple impacts on an object to drive it into a substrate. However, such multiple impact designs are not very efficient because of the constant motion reversal and the limited operator production speed.

A second design includes the use of potential energy storage mechanisms (in the form of a mechanical spring). In these designs, the spring is cocked (or activated) through an electric motor. Once the spring is sufficiently compressed, the energy is released from the spring into a striker, thus impacting the striker and/or a substrate. Several drawbacks exist to this design. These include the need for a complex system of compressing and controlling the spring, and in order to store sufficient energy, the spring must be very heavy and bulky. Additionally, the spring suffers from fatigue, which gives the tool a very short life. Finally, metal springs must move a significant amount of mass in order to decompress, and the result is that these low-speed impacting devices result in a high reactionary force on the user.

To improve upon this design, an air spring has been used to replace the mechanical spring, i.e., compressing air within a guide assembly and then releasing the compressed air by use of a gear drive. One particularly troublesome issue with this design is the safety hazard in the event that the anvil jams on the downward stroke and the operator tries to clear the jam, he is subject to the full force of the anvil, since the anvil is predisposed to the down position in all of these types of devices. A further disadvantage to the air spring results from the need to have the ratcheting mechanism as part of the anvil drive. This mechanism adds weight and causes significant problems in controlling the drive action since the weight must be stopped at the end of the stroke. This added mass slows the drive stroke and increases the reactionary force on the operator. Additionally, because significant kinetic energy is contained within the air spring and piston assembly the unit suffers from poor efficiency. This design is further subject to a complicated drive system for coupling and uncoupling the air spring and ratchet from the drive train, which increases the production cost and reduces the system reliability.

A third means for impacting that is taught includes the use of flywheels as energy storage means. The flywheels are used to launch a hammering anvil that impacts a substrate. One major drawback to this design is the problem of coupling the flywheel to the driving anvil. This prior art teaches the use of a friction clutching mechanism that is both complicated, heavy and subject to wear. Further limiting this approach is the difficulty in controlling the energy—the mechanism requires enough energy to impact effectively, but retains significant energy in the flywheel after the drive is complete. This further increases the design complexity and size of such prior art devices.

All of the currently available devices suffer from one or more the following disadvantages:

- Complex, expensive and unreliable designs. Fuel powered mechanisms such as Paslode™ achieve portability but require consumable fuels and are expensive. Rotating flywheel designs such as Dewalt™ have complicated coupling or clutching mechanisms based on frictional means. This adds to their expense.
- Poor ergonomics. The fuel powered mechanisms have loud combustion reports and combustion fumes. The multiple impact devices are fatiguing and are noisy.
- Non-portability. Traditional impacting devices are tethered to a fixed compressor and thus must maintain a separate supply line.

High reaction force and short life. Mechanical spring driven mechanisms have high tool reaction forces because of their long drive times. Additionally, the springs are not rated for these types of duty cycles leading to premature failure.

Safety issues. The prior art "air spring" and heavy spring driven designs suffer from safety issues for impacting since the predisposition of the anvil is towards the substrate. During jam clearing, this can cause the anvil to strike the operator's hand.

The return mechanisms in most of these devices involve taking some of the drive energy. Either there is a bungee or spring return of the driving anvil assembly or there is a vacuum or air pressure spring formed during the movement of the anvil. All of these mechanisms take energy away from the drive stroke and decrease efficiency.

In light of these various disadvantages, there exists the need for a fastener driving apparatus that overcomes these various disadvantages of the prior art, while still retaining the benefits of the prior art.

SUMMARY OF THE INVENTION

In accordance with the present invention, an impacting apparatus is described which derives its power from an electrical source, preferably rechargeable batteries, and uses a motor to actuate a spring anvil assembly. The spring anvil assembly can include either a mechanical spring or a gas spring that is coupled to a piston. In an embodiment where the spring is a mechanical spring, the spring may be comprised of titanium, carbon fiber, an elastomer or steel, for example. After a sufficient movement of a piston in the spring anvil assembly, the piston commences movement and accelerates the spring anvil assembly (which assembly includes an anvil and a spring coupled to a piston.) The contact of the spring piston with a pusher plate (which pusher plate is secured to the tool frame) causes the spring anvil assembly to move, and in an embodiment, the movement is toward and into contact with a substrate or object to be driven into a substrate such that the anvil impacts the substrate or drives the object into the substrate. A post, fastener or other driven object can position the spring anvil assembly for the commencement of another operating cycle.

By using a gas spring in the spring anvil assembly with a short piston stroke, the present impacting apparatus is able to generate sufficient energy to impact a substrate and/or drive an object with only a small increase in pressure in the gas spring. This unexpectedly increased the efficiency of the apparatus since heat of compression is a significant source of energy inefficiency. (This aspect also reduces the size of the apparatus as the stroke of the gas spring piston is significantly less than the stroke of the anvil and anvil assembly).

The impacting/driving cycle of the apparatus disclosed herein may start with an electrical signal, after which a circuit connects a motor to the electrical power source. The motor is coupled to the spring anvil assembly through an interrupted drive mechanism, cam, or any other drive mechanism capable of providing for continuous impacting/driving. In an operational cycle of the drive mechanism, the mechanism alternatively (1) actuates the piston of the spring anvil assembly and (2) decouples from the piston to allow pressure or other force(s) to act on the spring piston. For example, during a portion of its cycle, an interrupted drive mechanism may move the piston to increase potential energy stored within the spring assembly. In the next step of the cycle, the mechanism decouples from the piston anvil assembly to allow the accumulated potential energy within the spring assembly to act on and actuate the piston. The piston thereupon moves and causes the spring anvil assembly to move and impact a substrate or drive an object, for example. A spring or other return mechanism is operatively coupled to the spring anvil assembly to return the spring anvil assembly to an initial position after the anvil has impacted a substrate or driven an object. In an embodiment, at least one bumper is disposed within or outside of the spring anvil assembly to reduce wear and tear on the spring anvil assembly that may otherwise occur in operation of the apparatus.

In an embodiment, the stroke or movement of the piston of the spring anvil assembly is less than one half the total movement of the spring anvil assembly. Further preferred is that the movement of the spring piston results in a volume decrease within the gas spring of less than 20% of the initial volume, thus reducing losses from heat of compression.

In an embodiment, a sensor and a control circuit are provided for determining at least one position of the gas spring and/or anvil to enable the proper timing for stopping the cycle of the apparatus and/or to detect a jam condition of the apparatus.

Accordingly, and in addition to the objects and advantages of the portable impacting apparatus as described above, several objects and advantages of the present disclosure are:

To provide a simple design for impacting apparatuses that has a significantly lower production cost than currently available devices and that is portable and does not require an air compressor.

To provide an impacting apparatus that mimics the pneumatic fastener performance without a tethered air compressor.

To provide an electrical driven high power impacting apparatus that has very little wear.

To provide an electric motor driven impacting apparatus in which energy is not stored behind the driving anvil, thus greatly enhancing tool safety.

To provide a more energy efficient mechanism for driving objects and impacting substrates than is presently achievable with a compressed air design.

These together with other aspects of the present disclosure, along with the various features of novelty that characterize the present disclosure, are pointed out with particularity in the claims annexed hereto and form a part of the present disclosure. For a better understanding of the present disclosure, its operating advantages, and the specific objects attained by its uses, reference should be made to the accompanying drawings and detailed description in which there are illustrated and described exemplary embodiments of the present disclosure.

DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

Figure 1:
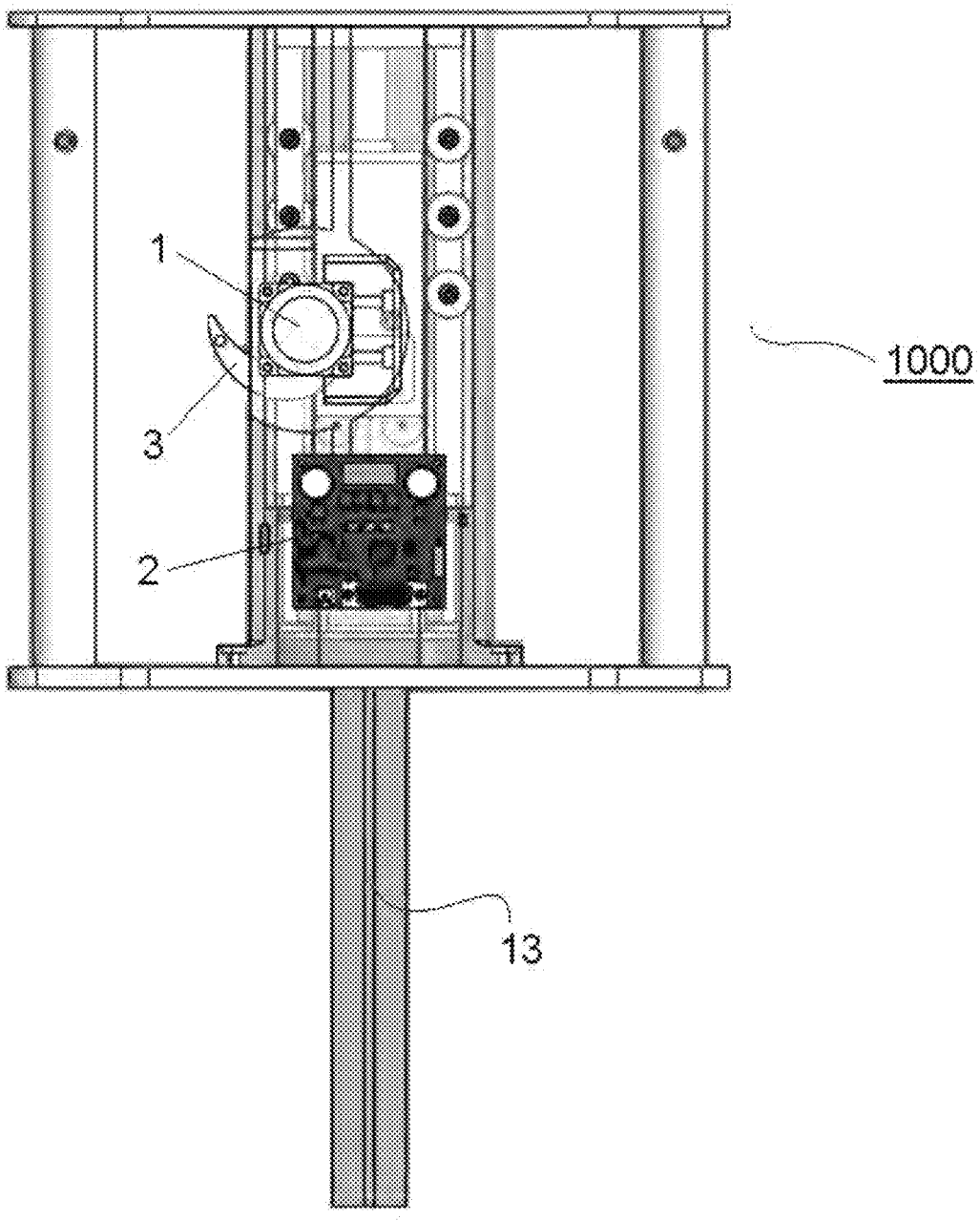
FIG. 1 shows a cutaway view of an impacting apparatus, in accordance with an exemplary embodiment of the present disclosure.
Figure 2:
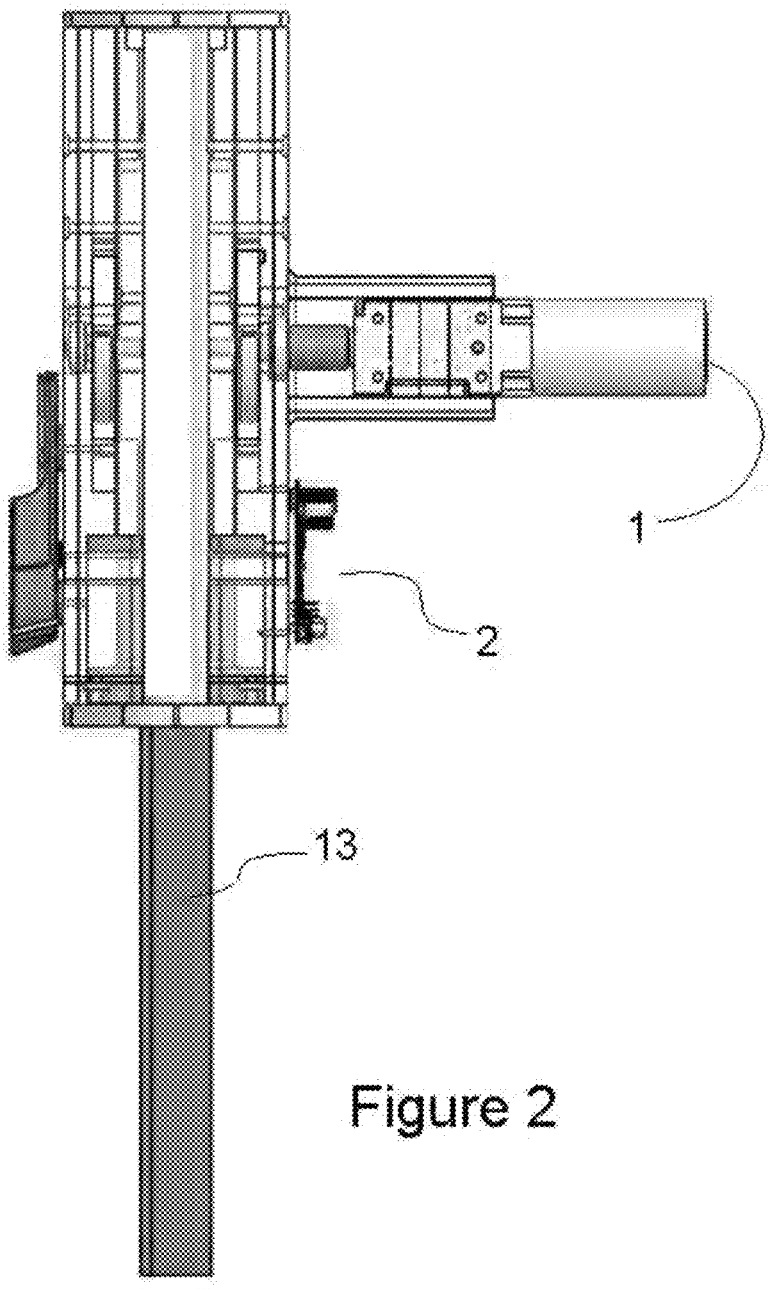
FIG. 2 shows another cutaway view of an impacting apparatus in accordance with an exemplary embodiment of the present disclosure.
Figure 3:
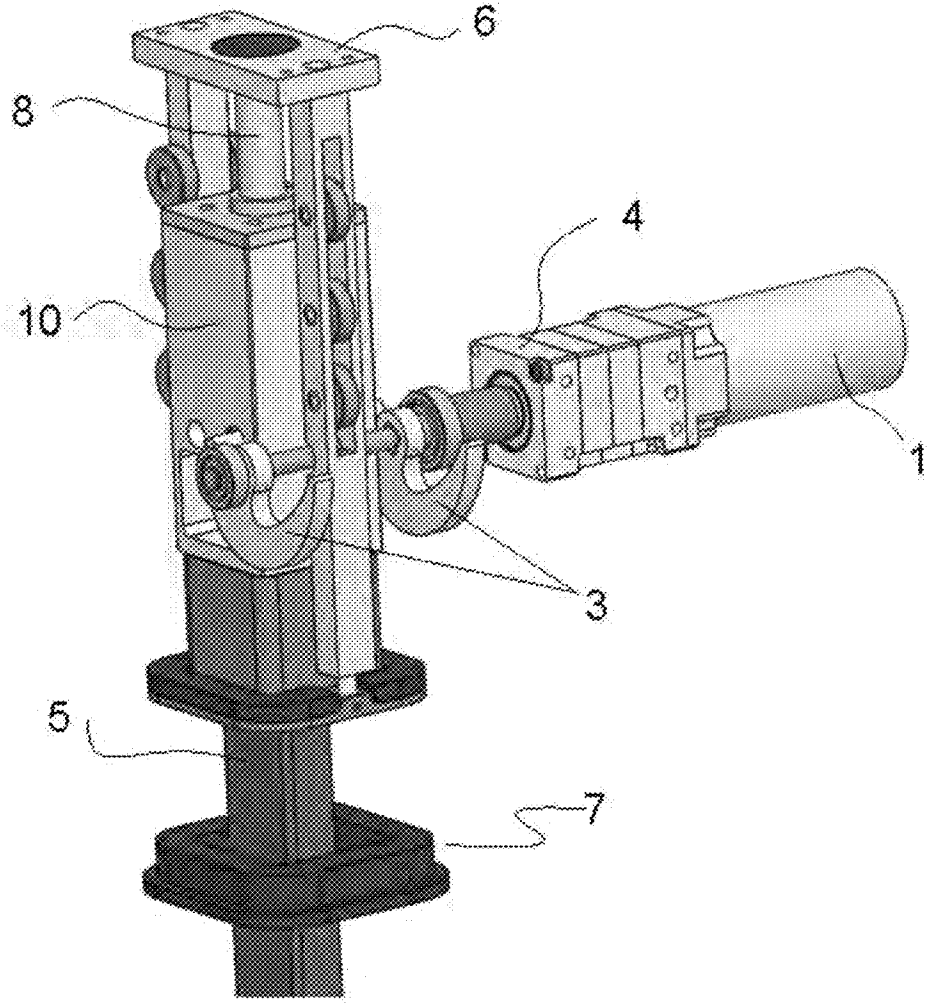
FIG. 3 shows an operational phase of an impacting apparatus, wherein the drive mechanism has not yet engaged the spring anvil assembly, in accordance with an exemplary embodiment of the present disclosure.
Figure 4:
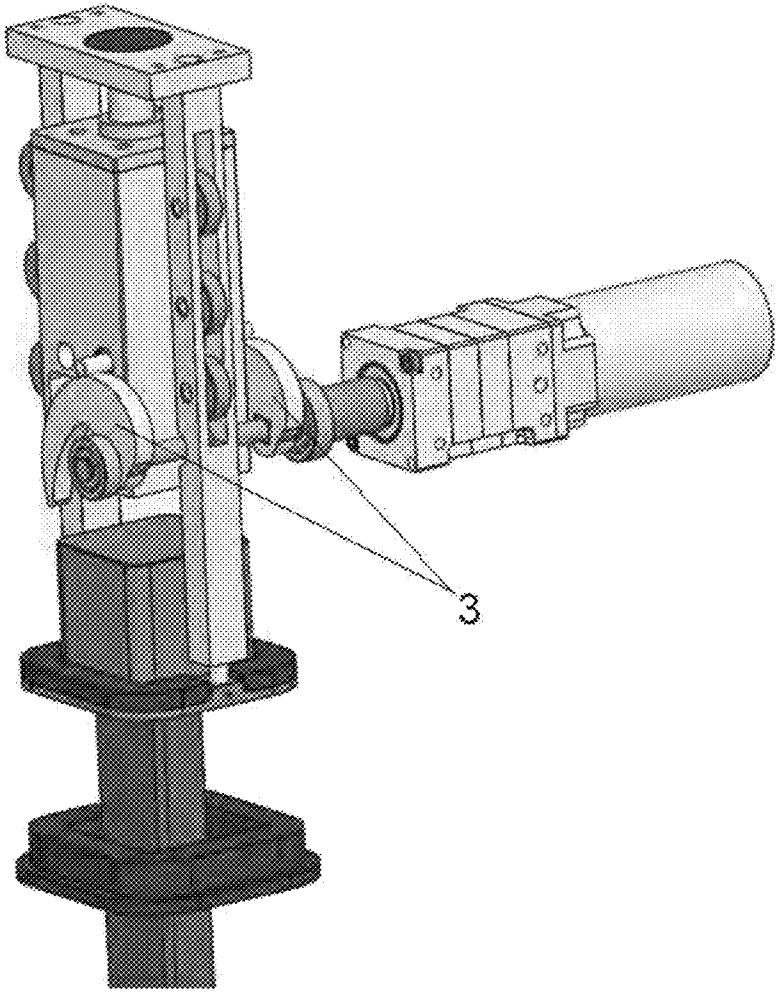
FIG. 4 shows another operational phase of an impacting apparatus, wherein the drive mechanism has engaged the spring anvil assembly in accordance, with an exemplary embodiment of the present disclosure.
Figure 5:
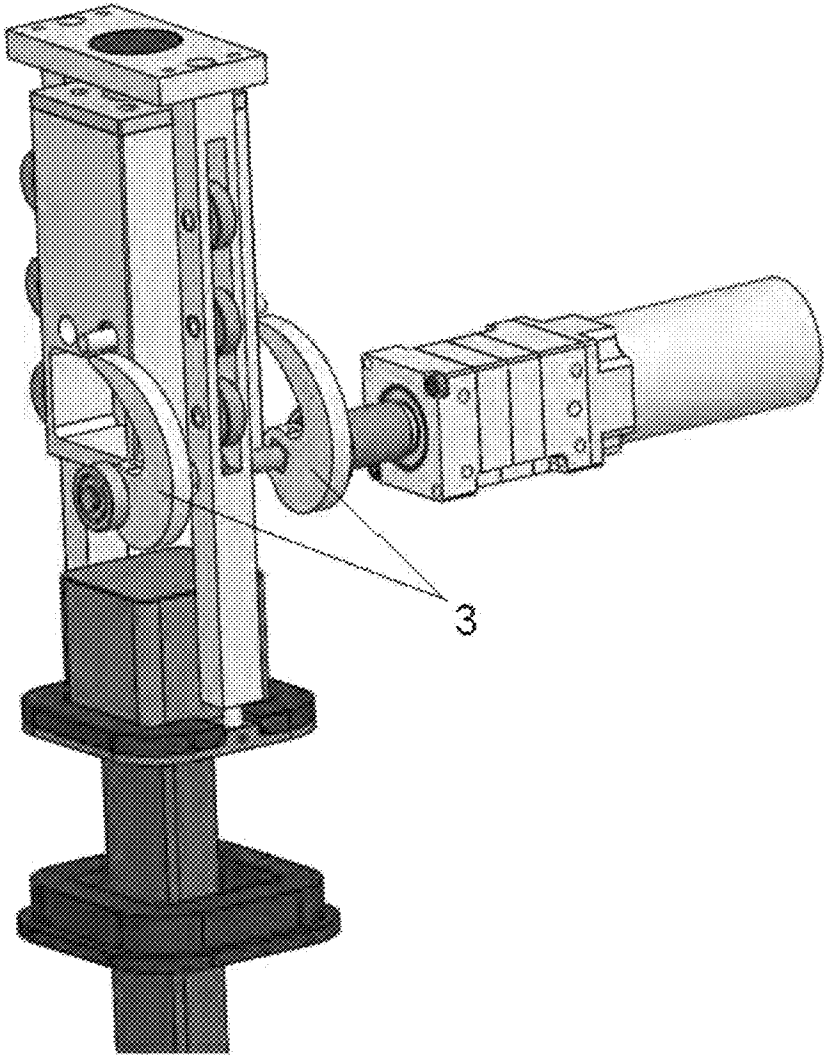
FIG. 5 shows another operational phase of an impacting apparatus, wherein the drive mechanism has engaged the spring anvil assembly, and is nearly to the point where it will again disengage the spring anvil assembly, in accordance with an exemplary embodiment of the present disclosure.
Figure 6:
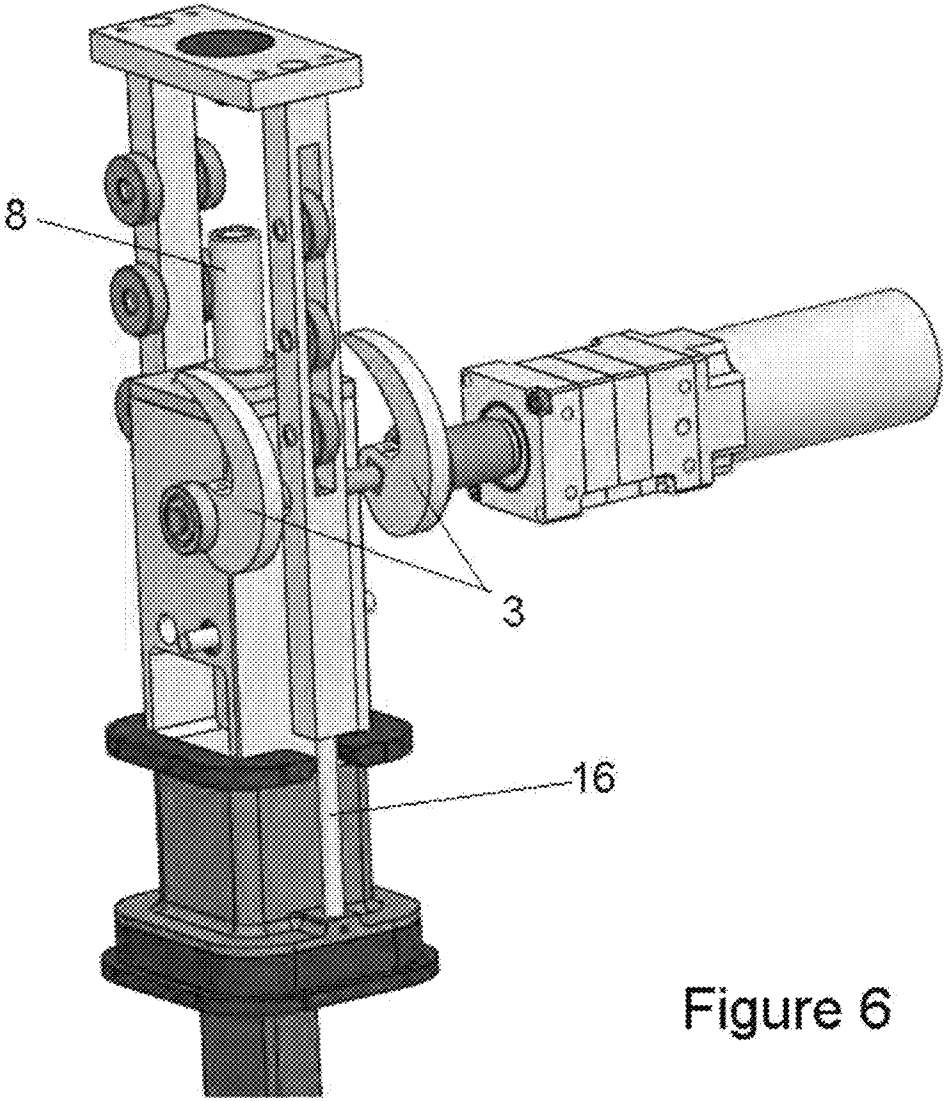
FIG. 6 shows an operational phase of an impacting apparatus, wherein the drive mechanism has disengaged the spring anvil assembly and the spring anvil assembly is in free flight, in accordance with an exemplary embodiment of the present disclosure.
Figure 7:
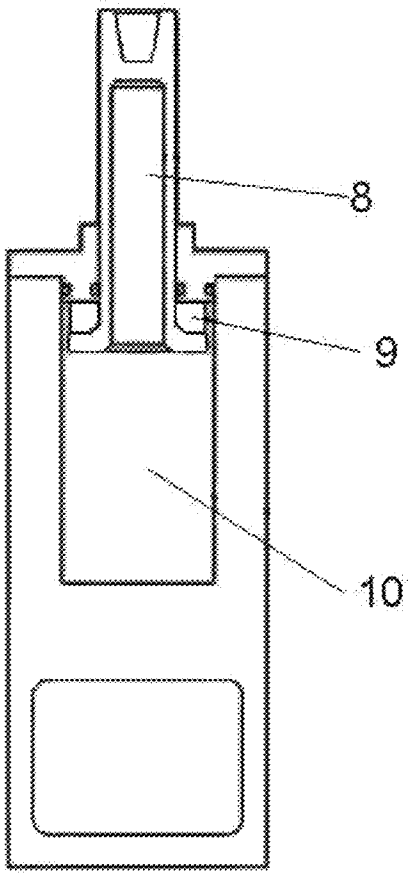
FIG. 7 shows a cutaway view of a spring anvil assembly, in accordance with an exemplary embodiment of the present disclosure.

The best mode for carrying out the present disclosure is presented in terms of its preferred embodiment, herein depicted in the accompanying figures. The preferred embodiments described herein detail for illustrative purposes are subject to many variations. It is understood that various omissions and substitutions of equivalents are contemplated as circumstances may suggest or render expedient, but are intended to cover the application or implementation without departing from the spirit or scope of the present disclosure. Furthermore, although the following relates substantially to one embodiment of the design, it will be understood by those familiar with the art that changes to materials, part descriptions and geometries can be made without departing from the spirit of the invention. It is further understood that references such as front, back or top dead center, bottom dead center do not refer to exact positions but approximate positions as understood in the context of the geometry in the attached figures.

The terms "a" and "an" herein do not denote a limitation of quantity, but rather denote the presence of at least one of the referenced items.

Referring to the figures, the present disclosure provides for an impacting apparatus 1000. In an embodiment, the apparatus comprises a power source, a motor 1, a control circuit 2, a drive mechanism 4, a spring anvil assembly, a striker 5, a pusher plate 6, and at least one bumper 7. In an embodiment, the spring anvil assembly comprises a gas spring 10 and an anvil 13. The gas spring 10 includes a piston 8 that is at least partially disposed within the spring anvil assembly. The spring anvil assembly is operatively coupled to the drive mechanism 4. A bumper 9 is preferably disposed within the gas spring to absorb a portion of the force of impact of the piston. The gas spring 10 may further comprise a nose portion (which nose portion may be a part of or coupled to the piston) and which nose portion makes operative contact with the pusher plate 6 during a portion of the operating cycle.

In another embodiment, the spring anvil assembly comprises a spring without a piston (such as, but not limited to, a mechanical spring or an elastomer) and an anvil 13.

The drive mechanism may comprise, in an embodiment, a rack gear with intervals of teeth and no teeth, or in an embodiment, a cam driven mechanism as shown in the figures. In such a rack gear embodiment, it will be apparent that the drive mechanism is configured to permit effectively instantaneous transition from when the gear teeth are engaged to when there is no tooth engagement. The drive mechanism is operatively coupled to the spring anvil assembly, such that the drive mechanism may alternate in actuating the spring anvil assembly, thereby actuating the piston (when the gear teeth or cam is engaged, for example) or, in another embodiment, actuating and compressing the spring of the spring anvil assembly, and in withholding a drive force on the spring anvil assembly such that other forces are able to act on and actuate the piston or spring.

In an embodiment, the drive mechanism engages the spring anvil assembly and actuates the piston by pushing it against the pusher plate to store potential energy within the gas spring. In an embodiment, the initial pressure (before the drive mechanism actuates the piston) within the gas spring assembly is at least 40 psia. The configuration and design of the gas spring are such that the pressure increase during the piston movement is less than 30% of the initial pressure, thus yielding a more constant torque to the motor that improves the motor efficiency. In another embodiment, the drive mechanism engages the spring anvil assembly and actuates the spring by pushing it against the pusher plate or by otherwise compressing the spring to store potential energy within the spring. The drive mechanism thereafter disengages the spring anvil assembly, allowing pressure or other forces to act on the piston and/or spring and cause the piston and/or spring to separate and launch the spring anvil away from the pusher plate and drive the anvil away from the pusher plate. The drive mechanism is tuned to prevent further engagement until after the spring anvil assembly has returned to an approximate starting position. The drive mechanism may thereafter again act on the spring anvil assembly to again store potential energy within the gas spring and/or spring and may thereafter again temporarily cease to act on the spring anvil assembly to allow potential energy to instead act on the piston and/or spring that has been pushing against the pusher plate (or which spring has been compressed) to launch the spring anvil assembly. The drive mechanism is preferably configured to allow for continuous impacting, by way of the cam, for example (as shown in the figures), to provide for such continuous impacting. In an embodiment, the stroke of the piston is less than the stroke of the spring anvil assembly.

In an embodiment, the spring anvil assembly is operatively coupled to the gas spring, such as to the piston or nose portion such that when the spring anvil assembly is released under pressure the force from the piston is imparted onto the spring anvil assembly, causing the spring anvil assembly to move in a direction and to release (or be launched) away from the pusher plate and impact a striker of the apparatus, which striker transmits the force of the impact to an impact target, such as a post, nail, or rivet, for example. In another embodiment, where the spring anvil assembly comprises a spring without a piston, when the spring anvil assembly is released with the spring having been compressed, the force from the spring is imparter onto the spring anvil assembly, causing the spring anvil assembly to move in a direction and to release (or be launched) away from the pusher plate and impact a striker of the apparatus, which striker transmits the force of the impact to an impact target, such as a post, nail, or rivet, for example. The striker facilitates positioning of the impact target so that the impact target can receive the force of the striker and so that the impact target can remain in a position to receive such force when the apparatus is providing multiple or continuous impacts. It was discovered during the course of development that the ratio of the thrown mass to the moving mass within the gas spring was important to the efficiency of the apparatus. It is preferred to have the thrown mass (which in this case is the anvil assembly) greater than 50% of the total moving mass (which is the anvil assembly mass+the gas spring moving mass), and more preferable to have the anvil assembly mass at least 60% of the total moving mass. This allows the present disclosure to have increased efficiency in transferring the potential energy into driving energy on the object or substrate. In an embodiment, the mass of the spring anvil assembly is two to four times the mass of the gas spring. In an embodiment, the gas spring piston has a mass of 90 grams and the anvil has a mass of 250 grams. In an embodiment, the gas spring piston is hollowed out to lighten its mass and further may be constructed of lightweight materials such as hard anodized aluminum, plastics or the like. The spring anvil assembly may be operatively coupled to a guide, shaft, or other structure that limits its range of motion.

At least one bumper is disposed on the apparatus for absorbing a portion of the force of impact of the piston within the gas spring and/or against the anvil, to reduce wear and tear on the components of the apparatus. The at least one bumper may be of an elastic material, and may be disposed on the apparatus at any position where it is capable of absorbing a portion of the force of impact by the piston or the anvil.

The spring anvil assembly may further comprise a return mechanism 16 to enable the spring anvil assembly to return to its initial position. In an embodiment, the return mechanism is a return spring that is disposed on or in the guide or shaft that constrains the spring anvil assembly, which return spring would be disposed nearer the end or portion of anvil that is distal to the gas spring. After the spring anvil assembly has moved, and after or in connection with the spring anvil assembly impacting a surface and/or driving an object, the return mechanism imparts a force on the spring anvil assembly to cause the spring anvil assembly to return to a position where it may again be operatively acted upon by the drive mechanism. In the embodiment where the return mechanism is a spring, the spring may be disposed with respect to the spring anvil assembly such that motion of the anvil toward an impact target also causes the spring to compress, and after the spring anvil assembly has reached the end of its driven stroke, the compressed spring decompresses to actuate the spring anvil assembly to the spring anvil assemblies earlier or original position.

An alternate embodiment for returning the spring anvil assembly to its cycle start position is to use the force of the impact target (such as a post, spike, nail or rivet) to bring the spring anvil assembly into its starting position. In such an embodiment, the return mechanism described above is omitted, and the spring anvil assembly is disposed in the down position (i.e., distal to the pusher plate) and rests atop the striker, before the operational cycle commences. When the spring anvil assembly is in such a down position, the operational cycle is unable to commence, which improves the safety profile of the apparatus. To allow the apparatus to operate, the striker is placed into contact with the impact target, and the weight of the apparatus or force applied to the tool by the user, causes the striker and the spring anvil assembly to be moved and disposed proximate to the pusher plate (i.e., the starting position of operational cycle, where the spring anvil assembly may be acted upon by the drive mechanism.) The striker can also be spring loaded away from the spring anvil assembly further adding to the safety of the tool.

This embodiment has several advantages. The first is that it would make it less likely to dry fire the apparatus as the apparatus must be in contact with the impact target to be able to operate. The second advantage is that no return mechanism would be required to reset the mechanism, thus eliminating an item that may otherwise wear during use of the apparatus.

The impact target is utilized to move (push) the spring anvil assembly into position against the pusher plate. A stop within the apparatus (disposed on or in the guide or shaft that constrains the spring anvil assembly, for example) may also be provided for preventing the impact target or striker from moving with the spring anvil assembly as it is energized. In this position the impact target would rest inside or against the striker and the striker would rest against a stop, preventing the impact target from moving up with the spring anvil assembly when the piston is being actuated to store potential energy within the gas spring. This allows the spring anvil assembly to still release from the pusher plate and re-engage the striker during the drive portion of the operational cycle.

In another embodiment, the apparatus further comprises a power adjustment mechanism for adjusting the force of impact by the apparatus. In an embodiment, the power adjustment mechanism comprises adjustable positioning of the pusher plate with respect to the spring anvil assembly. By changing such positioning of the pusher plate, the amount of compression of the spring of the spring anvil assembly can be adjusted, and force of impact is consequently adjusted by changing the amount of compression of the spring. The position of the pusher plate may be adjusted by way of a screw that may be actuated to reposition the pusher plate or by disposing the pusher plate on a slider, which slider may allow the pusher plate to be repositioned. In another embodiment, the power adjustment mechanism comprises an adjustment mechanism within the spring anvil assembly that allows changing the compression of the spring of the spring anvil assembly.

The present disclosure offers the following advantages: the gas spring is capable of generating a relatively high amount of force in a small amount of space such that the size of the apparatus may be smaller than other impacting apparatuses. Further, because of the relatively small increase from the initial pressure in the gas spring to the maximum pressure, the motor of the apparatus is not significantly overworked or overtorqued, thus leading to a longer useful life of the apparatus. Furthermore, the apparatus disclosed herein has an improved safety profile over prior art impacting devices. For example, the apparatus disclosed herein has an improved recoil force as opposed to the prior art. This was an unexpected discovery as the anvil/anvil assembly of the present disclosure is a free traveling mass and, as such, during the course of the driving of an object or striking a substrate, therefore does not put a reactionary force on the operator. In contrast, with conventional tools, air pressure on the piston and anvil assembly acts during the entire drive and at the end of the stroke can result in significant recoil to the operator.

The foregoing descriptions of specific embodiments of the present disclosure have been presented for purposes of illustration and description. They are not intended to be exhaustive or to limit the present disclosure to the precise forms disclosed, and many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. An impacting apparatus, the apparatus comprising
a power source,
a control circuit,
a motor,
a striker,
a spring anvil assembly, said spring anvil assembly comprising a gas spring and an anvil, said gas spring comprising a chamber and a piston,
and a drive mechanism capable of selectively engaging and disengaging said spring anvil assembly
wherein when said drive mechanism selectively engages said spring anvil assembly potential energy is increased in said gas spring and when said drive mechanism disengages said spring anvil assembly, potential energy from said gas spring decreases while accelerating the spring anvil assembly to impact a striker,
wherein during at least a portion of said drive stroke said drive mechanism disengages said spring anvil assembly and said gas spring piston does not exert an accelerating force on said spring anvil assembly.

2. The fastener driving apparatus of claim 1, wherein the total stroke of said gas spring piston is no more than 80% of the total stroke of said spring anvil assembly.

3. The impacting apparatus of claim 1, wherein the pressure increase within the gas spring caused by movement of said gas spring piston is less than 30%.

4. The impacting apparatus of claim 1, wherein said control circuit further comprises at least one sensor, wherein said at least one sensor may determine at least one of the position of said spring anvil assembly and the position of said drive mechanism.

5. The impacting apparatus of claim 1, said apparatus further comprising a pusher plate, wherein said spring anvil assembly acts on the pusher plate during a portion of the operational cycle of the apparatus to compress the spring of the spring anvil assembly, and wherein said spring anvil assembly ceases to act on a pusher plate prior to said anvil impacting the striker.

6. The impacting apparatus of claim 1, said apparatus comprising a bumper for absorbing the impact of the gas spring piston during an operational cycle of the apparatus.

7. The impacting apparatus of claim 1, further comprising a return mechanism for biasing said spring anvil assembly to a position where said gas spring is in a position to be compressed.

8. The impacting apparatus of claim 1, wherein the gas spring has a pressure of at least 300 psia for one portion of the operational cycle.

9. The impacting apparatus of claim 1 wherein the gas of said gas spring are comprised primarily of a non oxidizing gas and inert gas.

10. The impacting mechanism of claim 1, wherein said drive mechanism comprises a cam, said cam comprising a cam profile, and wherein said cam profile is configured such that during the portion of the operational cycle in which the gas spring is being compressed, the required torque to operate the cam varies no more than 30% for at least 70% of the cam rotation in which the gas spring is being energized.

11. The impacting apparatus of claim 1, wherein the mass of said spring anvil assembly is less than 15% of the mass of the apparatus.

12. The impacting apparatus of claim 5, said impacting apparatus further comprising a power adjustment mechanism for adjusting the force of impact by the apparatus, said power adjustment mechanism comprising one of an adjustment to the position of the pusher plate and adjustment to the amount of compression of the spring of the spring anvil assembly.

13. A impacting apparatus, the apparatus comprising
a power source,
a control circuit,
a motor,
a spring anvil assembly, said spring anvil assembly comprising a spring and an anvil,
a striker,
an impact target, and
a drive mechanism capable of selectively engaging and disengaging said spring anvil assembly wherein said drive mechanism is capable of selectively engaging said spring anvil assembly and thereafter disengaging from said spring anvil assembly to cease applying a force on said spring anvil assembly,
wherein when said drive mechanism engages said spring anvil assembly, potential energy is stored in said spring, and when said drive mechanism thereafter disengages said spring anvil assembly said spring releases its potential energy and accelerates said spring anvil assembly, said spring anvil assembly being in a state of free flight for at least a portion of the drive stroke before impacting a striker, and
wherein said striker is in contact with said impact target to deliver the impact energy from said spring anvil assembly to said impact target.

14. The impacting apparatus of claim 13, wherein the striker is biased away from the spring anvil assembly by an elastic element.

15. The impacting apparatus of claim 13, wherein said spring is a steel, titanium, elastomer or carbon fiber spring.

16. The impacting apparatus of claim 13, wherein said spring anvil assembly is biased back to its start position by force from one of the impact target and the weight of the apparatus.

17. The impacting apparatus of claim 13, said apparatus further comprising a pusher plate, wherein said spring anvil assembly acts on the pusher plate during a portion of the operational cycle of the apparatus to compress the spring of the spring anvil assembly, and wherein said spring anvil assembly ceases to act on a pusher plate prior to said anvil impacting the striker.

18. The impacting apparatus of claim 17, said impacting apparatus further comprising a power adjustment mechanism for adjusting the force of impact by the apparatus, said power adjustment mechanism comprising one of an adjustment to the position of the pusher plate and adjustment to the amount of compression of the spring of the spring anvil assembly.

19. An impacting apparatus, the apparatus comprising
a power source,
a control circuit,
a motor,
a spring anvil assembly, said spring anvil assembly comprising a spring, and an anvil,
a striker,
an impact target, and a drive mechanism capable of selectively engaging and disengaging said spring anvil assembly wherein said drive mechanism is capable of selectively engaging said spring anvil assembly and thereafter disengaging from said spring anvil assembly to cease applying a force on said spring anvil assembly, wherein when said drive mechanism engages said spring anvil assembly, potential energy is stored in said spring, and when said drive mechanism thereafter disengages said spring anvil assembly said spring releases its potential energy and accelerates said spring anvil assembly, said spring anvil assembly being in a state of free flight for at least a portion of the drive stroke before impacting a striker, wherein said striker is in contact with said impact target to deliver the impact energy from said spring anvil assembly to said impact target, and wherein said spring anvil assembly is biased to a start position by one of the impact target and the weight of the apparatus.

20. The apparatus of claim 19, wherein said spring anvil assembly further comprises a piston.

* * * * *